US007210647B2

(12) United States Patent
Dion

(10) Patent No.: US 7,210,647 B2
(45) Date of Patent: May 1, 2007

(54) REEL WITH LEVEL WINDING MECHANISM

(75) Inventor: Dennis Bruce Dion, Spring, TX (US)

(73) Assignee: PATCO Machine and Fabricating, Inc., Houston, TX (US)

( * ) Notice: Subject to any disclaimer, the term of this patent is extended or adjusted under 35 U.S.C. 154(b) by 11 days.

(21) Appl. No.: 11/134,830

(22) Filed: May 23, 2005

(65) Prior Publication Data

US 2006/0011765 A1 Jan. 19, 2006

(51) Int. Cl.
*B65H 54/28* (2006.01)

(52) U.S. Cl. ..... 242/397.3; 242/481; 242/483.5; 242/466

(58) Field of Classification Search ..... 242/397.2, 242/397.3, 397.5, 481, 483.5, 483.4, 486.8, 242/566; 254/385
See application file for complete search history.

(56) References Cited

U.S. PATENT DOCUMENTS 1,875,467 A * 9/1932 Knoerzer et al. ..... 242/483.5
5,950,953 A 9/1999 Baugh et al.

OTHER PUBLICATIONS 2 photos, PATCO single air motor level wind design. Dec. 2002.

* cited by examiner

*Primary Examiner*—Patrick Mackey
*Assistant Examiner*—William E. Dondero
(74) *Attorney, Agent, or Firm*—Beem Patent Law Firm

(57) ABSTRACT

A reel for receiving, storing, and paying out a cable, hose, or the like has a drum mounted in a frame and a level winding mechanism, which includes a carriage having a guide for the cable or hose, and a rotatable drive which moves the carriage approximately parallel to a rotational center of the drum. The rotatable drive is elongated and is mounted at each end on a mounting location attached to the frame. A source of motive power for rotating the rotatable drive is provided at each end thereof.

17 Claims, 5 Drawing Sheets

REEL WITH LEVEL WINDING MECHANISM

BACKGROUND OF THE INVENTION

1. Field of the Invention

This invention relates to spooling systems for the receiving, storage, and deploying of cables, hoses, and the like.

Present systems for winding cable onto spools, particularly on off-shore drill rigs, employ spools which are mechanically driven. Offshore drilling systems have reels with various capacities outside diameter cable for controlling of subsea blowout prevention equipment.

2. Prior Art

One such cable spooling system is disclosed in U.S. Pat. No. 4,767,073. With this type of system, as the cable is wound onto or off of the spool it is guided by a cable guide or "level wind" assembly mounted for traversing a reversible diamond groove shaft parallel to the axis of the spool. The cable guide assembly is coupled to tracking guide bars. Thus, the cable guide assembly traverses the diamond groove shaft and guide bars from one side to the other, evenly distributing the cable on the hub of the spool. When the cable gets to one end of the diamond groove shaft, it automatically reverses and continues to traverse in the other direction, continuously feeding the cable onto the spool. Many reels have been manufactured with this familiar diamond pattern lead screw mechanism to cause the line being wound onto the drum of the reel to be wrapped in an orderly and compact fashion. Probably the most common of these is the fishing reel.

The cable guide assembly connected to the same drive system which drives the axle of the spool by means of a chain drive system and sprockets. That is, one or more chains are coupled to the axle of the spool, and to the diamond groove shaft by means of one or more sprockets.

In another embodiment disclosed in U.S. Pat. No. 4,767,073, separate pneumatic motors are provided for the diamond bar and the spool axle respectively. One pneumatic motor drives the spool through a chain and connecting sprockets. The level wind system is rotated by a second pneumatic drive motor connected to the guide bar by a chain and sprockets. The guide bar is in turn geared to the diamond bar by another chain and set of sprockets. Since the level wind system is not directly coupled to the spool drive system, the level wind pneumatic motor is provided with a variable speed control to increase or decrease the speed as desired.

Also, Patco Machine and Fab., Inc., the assignee of this application, has previously manufactured a cable spooling system having one air motor for driving the spool and another air motor, coupled to the same control system, for driving the level wind assembly. However, this cable spooling system provided only a single air motor for the level wind assembly, such that it was driven only from a single end.

SUMMARY OF THE INVENTION

A general object of the invention is to provide a cable spooling system which evenly and automatically winds and unwinds a cable, hose or the like on a spool.

In accordance with the above object, a reel for accepting, holding, and deploying cable or hose, comprises a frame; a drum mounted in said frame and having a core and end flanges for storing said cable or hose; a level winding mechanism comprising means to control the position of said cable or hose along the width of said drum, said level winding mechanism comprising a carriage having a guide for said cable or hose a rotatable drive which moves said carriage approximately parallel to a rotational center of said drum, said rotatable drive being elongated and having respective ends, and motive means providing power for rotating said rotatable drive at each end thereof.

In accordance with another aspect of the invention, a level wind system is provided for a reel having a drum comprising a guide for reciprocal movements across the width of said drum of said reel, said level wind comprising a carriage having a guide for said cable or hose; a rotatable drive which moves said carriage approximately parallel to a rotational center of said drum, said drive being elongated and having respective ends, and motive means providing power for rotating said rotatable drive at each end thereof.

DESCRIPTION OF THE ILLUSTRATED EMBODIMENT

Figure 1:
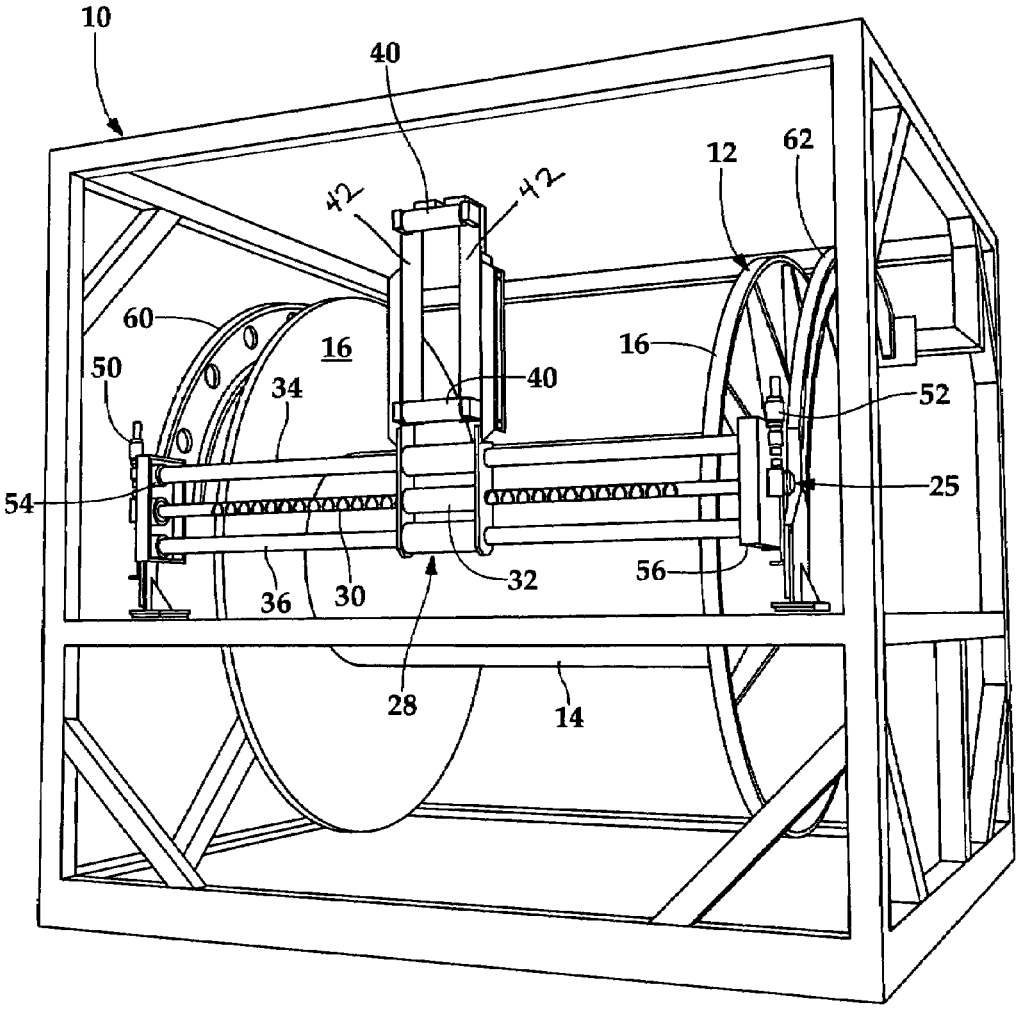
FIG. 1 is a front perspective view of a cable spooling system according to the present invention.
Figure 2:
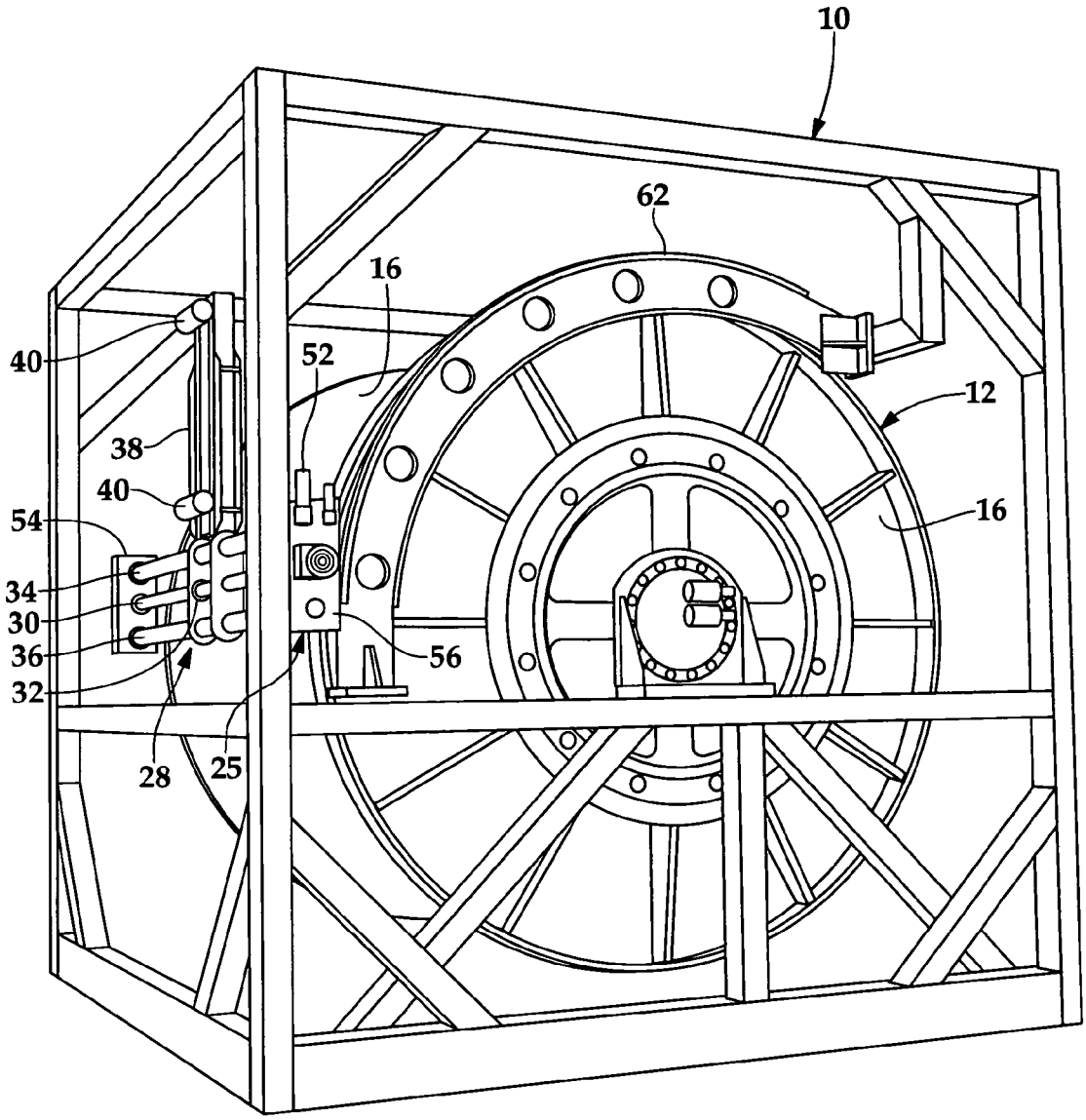
FIG. 2 is a side perspective view of the cable spooling system of FIG. 1.
Figure 3:
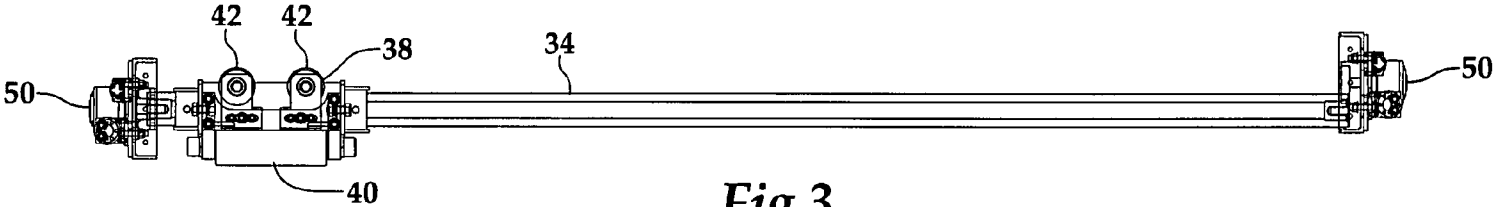
FIG. 3 is a top plan view illustrating a level wind assembly.
Figure 4:
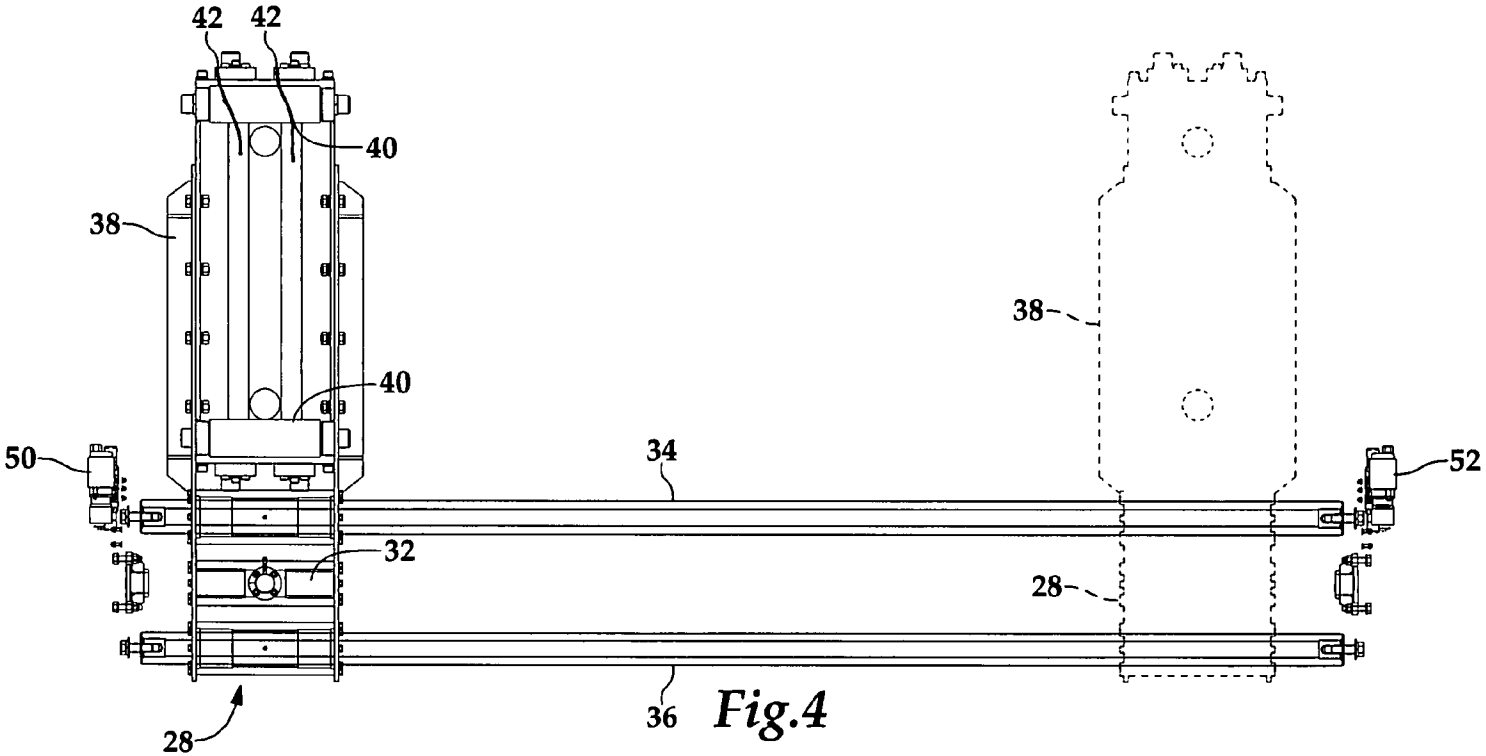
FIG. 4 is a front plan view illustrating the level wind assembly of FIG. 3.
Figure 6:
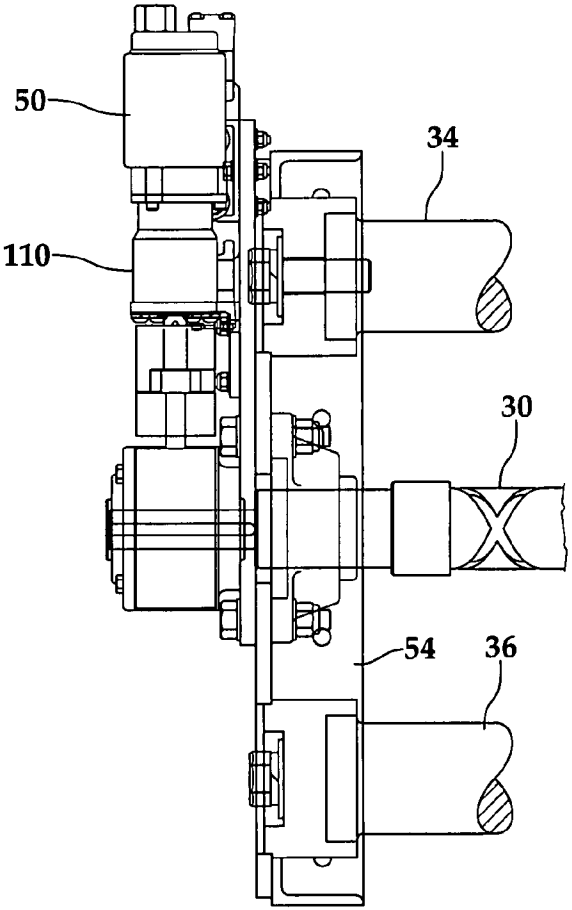
FIG. 6 is an end elevation view illustrating the drive assembly portion of FIG. 5.
Figure 5:
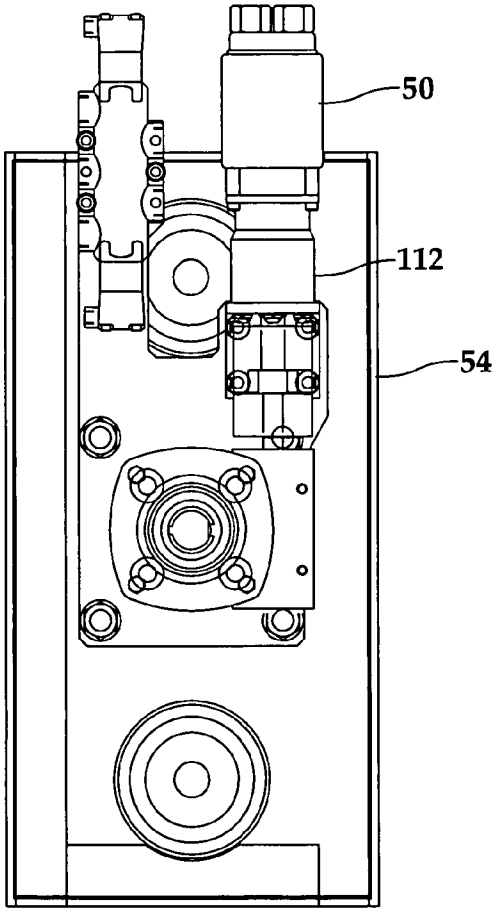
FIG. 5 is a detailed side elevation view illustrating a drive assembly portion of the level wind assembly of FIG. 3.

The cable spooling system of the present invention is shown generally in FIGS. 1 and 2, and comprises a frame 10 on which rotatably supports a cable spool 12 having a core or hub 14 and opposite end flanges 16. A cable (not shown) is guided onto and off from the spool for even wrapping by means of a cable guide or "level wind" assembly 25 having a carriage 28 mounted for traversing a reversible diamond groove shaft 30 by means of a follower 32, as the shaft 30 is rotated.

The carriage 28 is coupled to a pair of tracking guide bars 34, 36. The carriage 28 also mounts a frame 38 holding two sets of freely rotating rollers 40, 42 for contacting and guiding the cable. Upper and lower rollers 40, and right and left rollers 42 may be a relatively hard steel material or be coated with resilient materials such as rubber or plastics. Thus, the carriage 28 traverses the diamond groove shaft 30 from one side to the other, evenly distributing the cable on the hub 14 of the spool 12. When the carriage 28 gets to one end of the diamond groove shaft 30, it automatically reverses and continues to traverse in the other direction, continuously feeding the cable onto or off from the spool.

The cable guide assembly 25 is driven by a pair of air motors 50, 52, one coupled to either end of the diamond groove shaft 30 and powered by the same pneumatic air system which drives the cable spool 12. The motors 50, 52 are mounted to end brackets 54, 56 of the cable guide assembly 25, which also hold opposite ends of the reversible diamond groove shaft 30 and the guide bars 34, 36. These end brackets 54, 56 are in turn mounted to opposite arcuate supports, attached to the frame 10.

The pneumatic drive system powers the motors to wind the cable on the spool 12 and run the level wind 25. This system is comprised of a pneumatic air supply, typically supplying 350 SCFM, at 10 PSI maximum. The air supply is connected to the control system of FIG. 7, to which reference is invited, through an air filter 70, air regulator 72 and air lubricator 74. A reel control pilot valve 80 has an operating handle 82 which has a forward, center and reverse position. Thus, the cable spooling system can be operated to wind up cable or to feed out cable, as desired.

Each of the pneumatic air motors 50,52, as well as a reel motor 100, is operatively coupled to the pneumatic control system as shown in the schematic diagram of FIG. 7, which is described in greater detail below.

In the illustrated embodiment, an air filter, air regulator and air lubricator 70, 72 and 74, respectively comprise Norgren models F17-800 A3DA, R17-800-RGSA, and L17-800-MPDA. A control panel 75 includes pilot valves 80 and 84 and an air valve 87. The pilot valve 80 comprises a Rexroth series HD-2-X, #P50973-0003. A similar pilot valve 84 is provided for the motors 50, 52 and comprises a Rexroth series HD-2-FX, #P50970-0003, and is provided with a friction detent control handle 86 movable between forward and reverse positions. The respective pilot valves 80 and 84 are coupled to the remaining portion of the control system through respective shuttle valves 90, each of which comprises a Versa #SV-3-316. An additional air valve 87, which may be of the type Versa VSI-3301-316-43E, is interconnected between pilot valve 80 and the first of shuttle valves 90 for manual, independent operation of level wind. An output of the air filter 70 is also connected with the same line to pilot valve 80 as air valve 87.

One of the outlets of the pilot valve 80 feeds a pilot input of a relay valve 94, which also receives an output of the air lubricator 74. The output of this relay valve 94 is variable as a function the pilot input and fed to a P2 input of a valve 96, which also receives a P1 input from the air lubricator 74. The relay valve 94 may be of the type Rexroth 3P55163, while the valve 96 may be a Versa #VSP-8502. The output of valve 96 feeds the input of the relay valve 98, which may be a Rexroth # P55161, and which receives a pilot input from the pilot valve 87. The output of valve 98 is variable as a function of pilot input from valve 84 and feeds respective P inputs of valves 102 and 104, which may comprise Versa # VJJ-4503 air valves.

The outputs of valves 102 and 104 drive the respective motors 50 and 52, which in turn drive the diamond screw 30 via appropriate gear reducers 110, 112. The pilot valve 84 is also coupled to inputs of air valves 114, 116, which may be versa # VJJ 4503, and which also receive pilot inputs from the pilot valve 87. The valves 114 and 116 also feed respective pilot inputs of the valves 102, 104 by way of suitable interconnecting components, including shuttle valves 116, 118, which may be the same type as shuttle valves 90. Appropriate air exhaust silencers, such as Arrow #ASP-2 and/or Arrow #ASP-4, may be provided for various valves, as indicated in FIG. 7.

The air motor 100 receives an air supply from an air valve 101, which in turn is supplied by the air relay valve 94 and has pilot inputs from the pilot valve 80. The valve 101, an integral part of air motor 100, has two outputs, each of which feeds one side of the air motor 100, in order to drive the air motor, and therefore the spool, in both directions. For the larger diameter valve 101, as well as for air motor 100, which drives the spool 12, the silencers may be of the type Allied Witan #033010, or 0383012.

The air motor 100 may drive the spool through a planetary reducer 130 and a chain and sprockets 132, 134. The planetary reducer may be of the type Brevini #PD3065/MR2/208.2/RM310. In the illustrated embodiment, the gear 132 is a 16 tooth gear, while the gear 134 is a 40 tooth gear, giving a 2.5:1 chain reduction.

A pair of disc brake calipers 120, 122 for the motor 100 braking system are interconnected to the air control system by way of valve 92 and a quick exhaust valve 124, which may be of the type Versa #QE-3-316. In the illustrated embodiment, the air motor 100 is a radial piston motor, such as the Fenner SPX #R33-X-XX-R1. The air motors 50 and 52, may be Ingersoll-Rand #3840 P, 1.35 horsepower. The gear reducers 110, 112 may be Hub City #0220-74871 (W300A) and #0220-74895 (W300B), respectively, having a 40:1 ratio. Lovejoy couplings, such as #L100SST, may be used between the motors 50, 52 and the gear reducers 110, 112.

Figure 7:
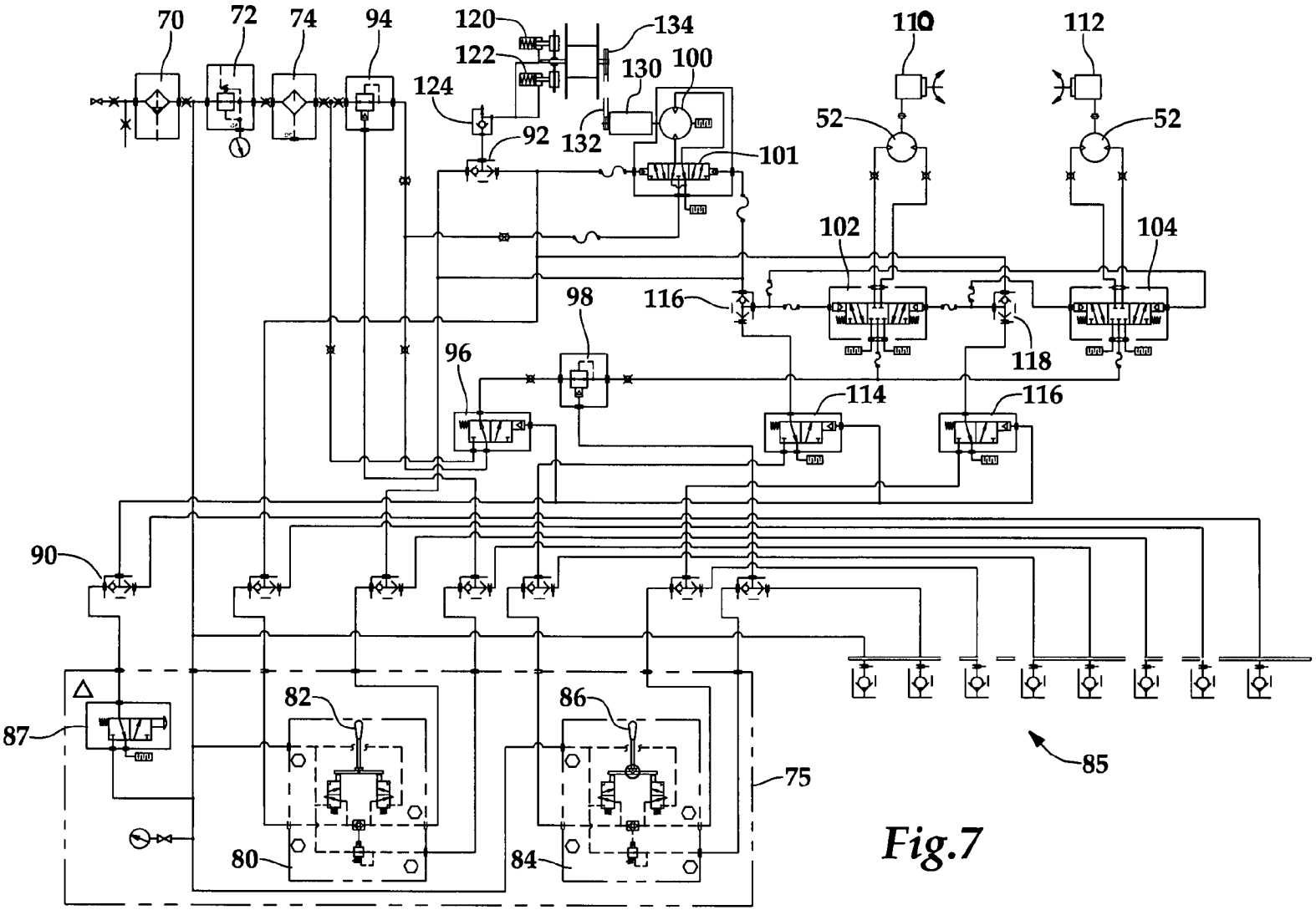
FIG. 7 is a schematic diagram illustrating the operation of the pneumatic drive system of the cable spooling system.

Appropriate ball valves and needle valves, as indicated schematically, may be interposed in the various interconnecting lines in the diagram of FIG. 7.

A remote-control (not shown) is constructed substantially identically with the control panel 75 shown in FIG. 7. This remote-control may connect with the control system of FIG. 7 by way of a series of inputs 85, which are essentially paralleled with the outputs of the local control panel 75.

Since the level wind system is directly coupled to the spool air drive system, level wind air motors 50 and 52 provide a proportionally variable speed control to increase or decrease the speed of the reversible diamond groove shaft 30 of the level wind system with variations in the speed of the cable spool 12. Moreover, since the motors 50 and 52 are controlled by the same control circuit (see FIG. 7), they are always "in synch", thereby avoiding any uneven or unequal drive of the two ends of the reversible diamond groove shaft 30.

To reel up a cable, an end of the cable is passed through the frame 38 holding the sets of rollers 40, 42, and a few wraps are started on spool 12. The control lever 82 is then switched to the reel in position and air drive motor 100 is adjusted for the proper speed. The motor 100 can be reversed by moving lever 80 to the out position, to reverse spool rotation for continuously and evenly feeding out cable.

The respective motors 50, 52 drive each end of the diamond groove shaft 30, as mentioned above. This is in contrast to the prior art, described above, wherein a chain or motor drive was used only at one end of the diamond groove shaft 30. Use of the air motor present several advantages over a chain drive, for example. In particular, the air motor, as shown further and FIG. 7, is driven from the same air system which drives the motor which rotates the spool. Moreover, the speeds of the motors 50 and 52 relative to the speed of rotation of the spool 12 can also be readily controlled, and is self-regulating, any increase/decrease in air supply to the spool will automatically result in a proportionate increase/decrease in the air supply to the motors 50, 52. This arrangement automatically balances the motive forces at both ends of the diamond groove shaft 30, without further operator intervention, thereby avoiding the twisting, torque or torsional forces which might otherwise be applied, particularly on relatively long reels having correspondingly long diamond groove shafts in the associated level wind assembly.

In contrast to prior art systems using a single chain drive or motor, such as an air motor, to drive the diamond groove shaft 30, the present invention uses one motor at either end of this shaft 30. It will be appreciated that with increasing width of the spool 12 and consequent increasing length of the diamond groove shaft 30, there can be some twisting or deformation of the diamond groove shaft 39 when only a single-end drive is provided. Accordingly, the present invention avoids the possibility of this distortion and the consequent possible inaccuracies in movement of the level wind assembly 25 relative to the spool 12, thereby reducing stress on the system and the risk of mechanical failure.

The foregoing disclosure and description of this invention are illustrative and explanatory thereof, and various changes in the size, shape, and materials as well as the details of the illustrated construction may be made without departing from the spirit of the invention.

I claim:

1. A reel for accepting, holding, and deploying cable or hose, comprising:

a frame;

a drum mounted in said frame and having a core and end flanges for storing said cable or hose;

a level winding mechanism comprising means to control the position of said cable or hose along the width of said drum, said level winding mechanism comprising;

a carriage having a guide for said cable or hose;

a rotatable drive which moves said carriage approximately parallel to a rotational center of said drum, said rotatable drive being elongated and having respective ends; and a first motor providing power for rotating said rotatable drive at one end thereof and a second motor providing power for rotating said rotatable drive at the other end thereof, wherein said first motor and said second motor are operatively coupled with a control system so that said first motor and said second motor operate generally in synchronization with one another.

2. The invention of claim 1, wherein said guide comprises an upper roller and a lower roller.

3. The invention of claim 1, wherein said rotatable drive is a lead screw.

4. The invention of claim 3, wherein said lead screw is a reversing lead screw.

5. The invention of claim 4, wherein said first motor and said second motor coordinate the rotation of said lead screw with the rotation of said drum.

6. The invention of claim 3, wherein said lead screw has both left hand and right hand leads which cross in a diamond pattern.

7. The invention of claim 1, wherein said first motor is a first air motor coupled to one end of said lead screw and mounted on said frame and said second motor is a second air motor coupled to the other end of said lead screw and mounted on said frame.

8. The invention of claim 7, wherein said control system is a pneumatic control system.

9. The invention of claim 8, wherein said pneumatic control system also controls a motor which rotates said drum.

10. A level wind for a reel having a drum comprising a guide for reciprocal movements across the width of said drum of said reel, said level wind comprising a carriage having a guide for a cable or hose;

a rotatable drive which moves said carriage approximately parallel to a rotational center of said drum, said drive being elongated and having respective ends; and a first motor providing power for rotating said rotatable drive at one end thereof and a second motor providing power for rotating said rotatable drive at the other end thereof, wherein said first motor and said second motor are operatively coupled with a control system so that said first motor and said second motor operate generally in synchronization with one another.

11. The invention of claim 10, wherein said first motor is a first air motor coupled to one end of said rotatable drive and said second motor is a second air motor coupled to the other end of said rotatable drive.

12. The invention of claim 11, wherein said control system is a pneumatic control system.

13. The invention of claim 12, wherein said pneumatic control system also controls a motor which rotates said drum.

14. The invention of claim 9, wherein said rotatable drive is a lead screw.

15. The invention of claim 14, wherein said lead screw has both left and right hand leads which cross in a diamond pattern.

16. A reel for accepting, holding, and deploying cable or hose, comprising:

a frame;

a drum mounted in said frame and having a core and end flanges for storing said cable or hose;

a level winding mechanism comprising means to control the position of said cable or hose along the width of said drum, said level winding mechanism comprising a carriage having a guide for said cable or hose, a rotatable drive which moves said carriage approximately parallel to a rotational center of said drum, said rotatable drive being elongated and having respective ends; and a first air motor providing power for rotating said rotatable drive at one end thereof and a second air motor providing power for rotating said rotatable drive at the other end thereof, wherein each said air motor is operatively coupled with a pneumatic control system said first air motor and said second air motor operate generally in synchronization with one another.

17. The invention of claim 16, wherein said pneumatic control system also controls a motor which rotates said drum.

* * * * *

UNITED STATES PATENT AND TRADEMARK OFFICE

CERTIFICATE OF CORRECTION

PATENT NO. : 7,210,647 B2
APPLICATION NO. : 11/134830
DATED : May 1, 2007
INVENTOR(S) : Dennis Bruce Dion It is certified that error appears in the above-identified patent and that said Letters Patent is hereby corrected as shown below:

In claim 7, at column 5, line 48, the number "1" should be changed to --3--.

In claim 16, at column 6, line 50, the words --so that-- should be inserted after the words "pneumatic control system."

Signed and Sealed this

Third Day of July, 2007

JON W. DUDAS
*Director of the United States Patent and Trademark Office*